US005730109A

United States Patent [19]

Nozawa

[11] Patent Number: 5,730,109

[45] Date of Patent: Mar. 24, 1998

[54] EXHAUST GAS PURIFICATION SYSTEM IN COMBUSTION ENGINE

[75] Inventor: Hideaki Nozawa, Tokyo, Japan

[73] Assignee: TAG Co., Ltd., Tokyo, Japan

[21] Appl. No.: 556,846

[22] Filed: Nov. 2, 1995

[51] Int. Cl.[6] ..... F02B 75/12

[52] U.S. Cl. ..... 123/538

[58] Field of Search ..... 123/536, 537, 123/538, 467, 506

[56] References Cited

U.S. PATENT DOCUMENTS

| | | | |
|---|---|---|---|
| 4,429,665 | 2/1984 | Brown | 123/538 |
| 4,437,443 | 3/1984 | Hofbauer | 123/467 |
| 4,627,571 | 12/1986 | Kato et al. | 123/467 |
| 4,662,338 | 5/1987 | Itoh et al. | 123/467 |
| 4,715,325 | 12/1987 | Walker | 123/538 |
| 4,930,483 | 6/1990 | Jones | 123/538 |
| 5,044,346 | 9/1991 | Tada et al. | 123/538 |
| 5,044,347 | 9/1991 | Ullrich | 123/538 |
| 5,092,303 | 3/1992 | Brown | 123/538 |
| 5,154,153 | 10/1992 | MacGregor | 123/538 |
| 5,533,490 | 7/1996 | Pascall | 123/538 |

*Primary Examiner*—Marguerite McMahon
*Attorney, Agent, or Firm*—Kanesaka & Takeuchi

[57] ABSTRACT

In an exhaust gas purification system according to the invention, a liquid fuel is jetted into the engine cylinder at a high pressure in turbulence in such a condition as easily burned. A spiral metal tube ring is accommodated in the fuel supply, system as a fuel activation device such that molecules of the liquid fuel passing therethrough are activated and atomized by contacting the metal spiral tube ring. The spiral tube may be a single member or of a composite structure.

11 Claims, 5 Drawing Sheets

EXHAUST GAS PURIFICATION SYSTEM IN COMBUSTION ENGINE

BACKGROUND OF THE INVENTION

The present invention relates to an exhaust gas purification system in a combustion engine and more particularly to an exhaust gas purification system in an internal combustion engine, especially a diesel engine, which suppresses the generation of noxious nitrogen oxides, sulfuric oxides, unburned carbon particles such as soots contained in exhaust gases produced as a result of combustion of fossil fuels.

While the fossil fuels typified by petroleum have brought about an industrial revolution, it is also known that the earth's environment is now subject to a drastic change. The exhaust gases produced by combustion of fossil fuels, more particularly, petroleum familiar to us contain a huge amount of noxious nitrogen oxides, sulfuric oxides, unburned carbon particles such as soots to endanger the existence of animals and plants. Particularly, nitrogen oxides discharged from automobiles are responsible for 70% of such exhaust gases, so that it is impossible to suppress the pollution of the earth's environment without solving this problem.

In order to solve the above problem, various measures have so far been proposed to cope with the exhaust gases: a process to suppress the generation of noxious components due to combustion of the fuel by removing, in the process of purification, components such as sulphur which can become a noxious component by combustion of the fuel; an approach by improving an engine itself as opposed to the improvement of the fuel, particularly a rarefied combustion process which maintains the combustion temperature lower than the conventional diesel engine to suppress the generation of nitrogen oxides; and an exhaust gas treatment to make the molecular structure steady by use of catalysts before discharging the exhaust gas into the air.

Those measures are disclosed in Japanese Pat. Appln. Kokai Pub. No. 2-119921 and No. 2-103920 which relate to purification of the exhaust gas in the process of being exhausted into the air.

A prior art example of the rarefied combustion method is disclosed in Japanese Pat. Appln. Kokai Pub. No. 3-134236 as the method of preventing nitrogen oxides, hydrocarbons or carbon monoxide from being generated by controlling an air-fuel ratio.

As far as nitrogen oxides are concerned, it is conceived of that ammonia is subjected to thermal decomposition to form $NH_2$ which is further mixed with the exhaust gas for reduction thereof. Although, ammonia is needed by the automobile for this purpose, it is not practical as a purifier.

The method of removing sulphur in advance in the process of purification of the fuel can be classified as a preferable measure in view of supplying clean fuels though it lacks the immediate effects in the present imminent environmental situation and has a problem that accomplishment of the purpose seems too time-consuming for an emmergency measure to solve the exhaust gas problem.

On the other hand, the exhaust gas treatment by adding other substances or involving chemical reactions with the use of catalysts requires some heavy-duty facilities which may be suited to the exhaust gas purification facilities in plants but not to automotive purposes. Further, while the rarefied combustion method well prevents the production of nitrogen oxides by controlling the combustion in the rarefied air-fuel ratio to suppress the rise of combustion temperatures, there is another problem of the reduced combustion power to lower the torque of the engine output.

This forces the users to reduce the efficiency of the automobile, thus involving another unfavorable problem of the rise of transportation costs.

SUMMARY OF THE INVENTION

In order to cope with the exhaust gas problems without lowering the efficiency, a heavy duty engine is in demand. This means that while freight cars equipped with the heavy duty engine to obtain a high power may solve the problem of trasportation costs, the amount of exhaust gas increases with such high exhaust gas emission, creating the problem of increased noxious substances.

It is, therefore, an object of the present invention to provide a system which is capable of purifying the exhaust gas by means of a system other than the rarefied combustion method of exhaust gas treatment with catalysts.

In order to accomplish the aforementioned object, the present invention provides, in one aspect, an exhaust gas purification system comprising a fuel supply system for a liquid fuel, metal coil means accommodated in said fuel supply system for activating kinetic movement of molecules of said liquid fuel, whereby the liquid fuel contacts said metal coil means to be activated such that said fuel is atomized into particles having an increased jetting power.

In another aspect, the invention provides an exhaust gas purification system comprising a fuel supply system for a liquid fuel, and metal coil means accommodated in said fuel supply system for charging electricity to molecules of said liquid fuel, whereby the liquid fuel passing through an extra narrow gap in the fuel supply system at a high speed is electrically charged, said liquid fuel being jetted into a high pressure high temperature atmosphere to discharge electricity for ignition thereof.

BRIEF DESCRIPTION FOR THE DRAWINGS

DESCRIPTION OF THE PREFERRED EMBODIMENTS

Figure 1:
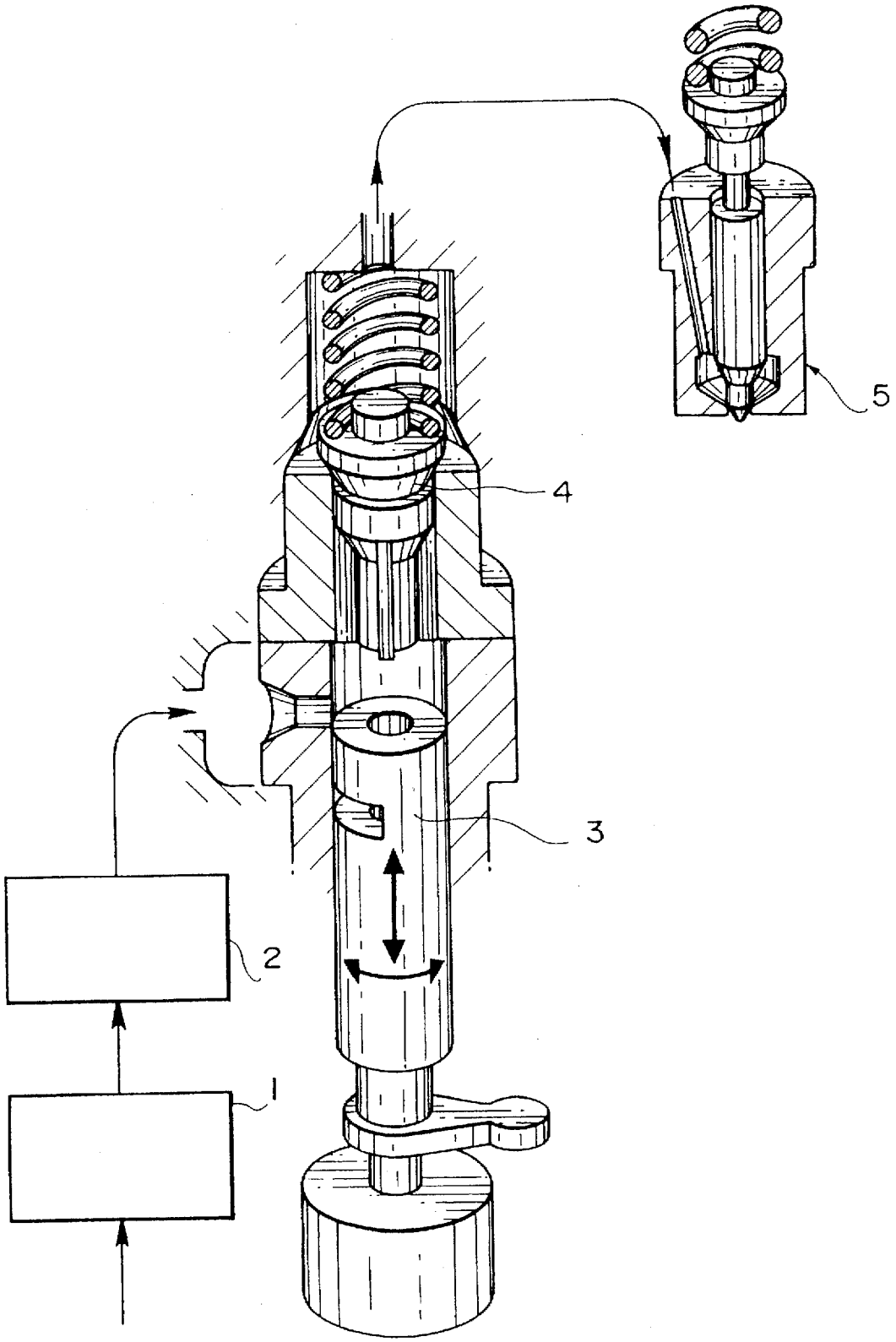
FIG. 1 is an explanatory sectional view of the fuel supply system incorporating the present invention.
Figure 2:
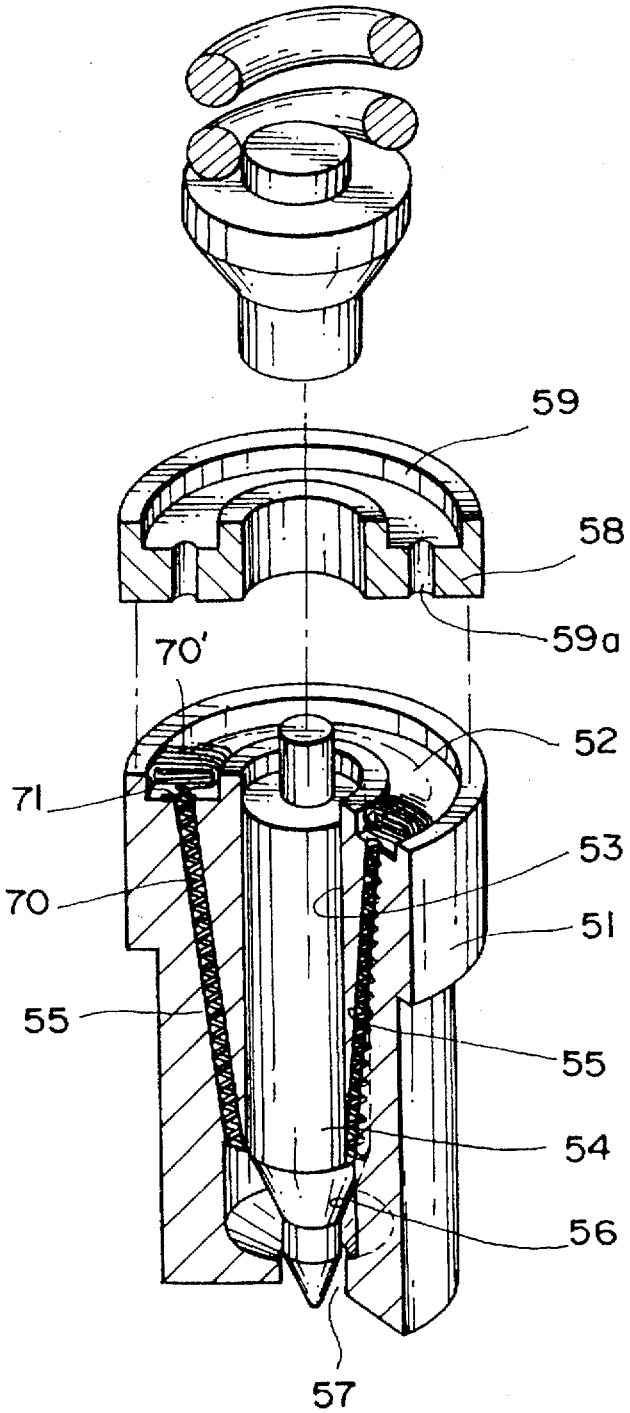
FIG. 2 is an exploded view of the jet nozzle partly in cross section.
Figure 3:
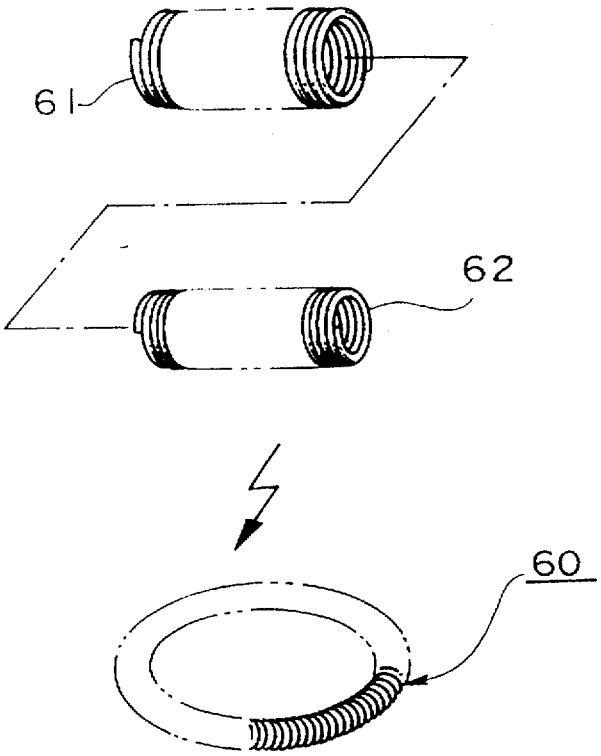
FIG. 3 is a perspective view of the metal coil means in a disassembled state thereof in one embodiment of the present invention.
Figure 4:
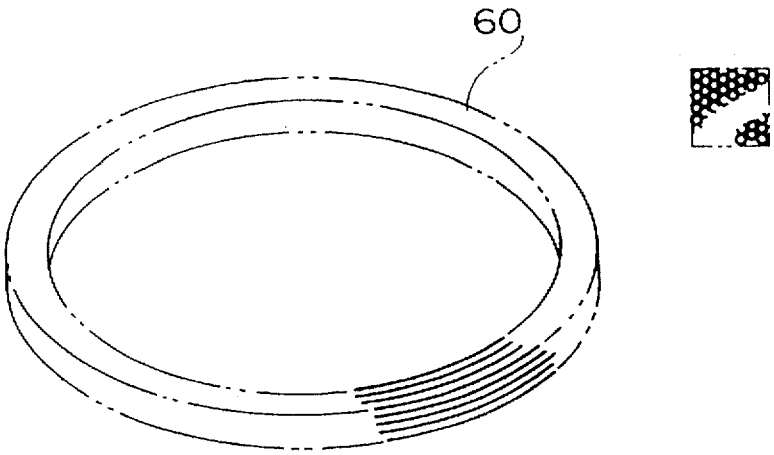
FIG. 4 is a perspective view of the metal coil means in another embodiment used in place of the metal coil means used in the embodiment of FIG. 3.
Figure 5:
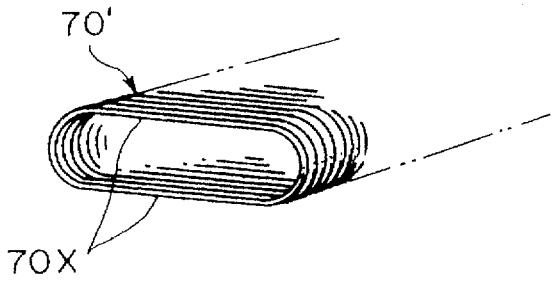
FIG. 5 is a cross sectinal view of a further modification of the metal coil means.
Figure 6:
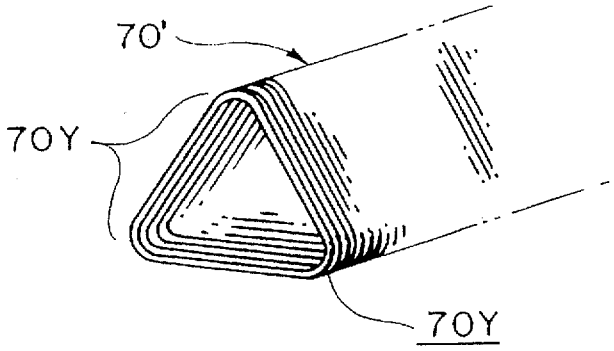
FIG. 6 is a cross sectional view of a still further modification of the metal coil means.

Hereinafter, embodiments of the present invention will be explained referring to FIGS. 1 through 8 attached hereto. In the figures, numeral 1 designates a feed pump, by means of which the fuel from the fuel tank is supplied by way of filter 2 to plunger 3. Delivery valve 4 is opened by the delivery power of said plunger 3 so that the fuel is further admitted to jet nozzle 5 to jet out the fuel into the cylinder to complete the fuel supply system.

The passage leading from feed pump 1 to jet nozzle 5 constitutes the fuel supply system in which spiral tube 60 is accommodated in jet nozzle 5 as a means of activating the fuel which will be explained in detail.

Spiral tube 60 is accommodated in a space defined in fuel pocket 52 formed in nozzle body 51 which constitutes jet nozzle 5. Since said fuel pocket 52 is in the form of annular groove space, spiral tube 60 is of an annular shape, said spiral tube being formed to have a substantially equal circumferential size and a substantially equal width to said fuel pocket 52. Namely, the spiral tube 60 is selected to be properly accommodated in the fuel pocket 52.

Said jet nozzle 5 has needle 54 accommodated in a space centrally formed within said nozzle body 51 or in so-called needle guide 53, said fuel being supplied to pocket 58 near the jet exit by way of three supply passages 55 which provide communication between said fuel pocket 52 and fuel pocket 58 such that the predetermined fuel is jetted into the cylinder when the needle opens valve seat or opening 57.

The spiral tube ring 60 is formed by inserting a coil member or counterclockwise spiral tube 62 into the inside of a coil member or clockwise spiral tube 61 of a slightly larger inside diameter than said counterclockwise spiral tube 62 and then connecting the free ends of said clockwise spiral tube 61. The winding directions of said spiral tube 61 and said spiral tube 62 are preferably opposite. If unavoidable, however, spiral tubes of the identical winding directions may be used. Further, spiral tube 62 may be omitted in view of a size requirement while a further spiral tube may further be inserted into said spiral tube 62.

It is observed that if copper oxides (CuO, $Cu_2O$), iron (Fe), nickel (Ni), cobalt (Co) or gold (Au) is used as a material for tube ring 60, a light oil fuel is preheated under the jet pump pressure of 100 to 300 kg/cm$^2$ and further heated in the reductive atmosphere with the result that the fuel is activated by some action of said metals.

In this instance, the light oil is transformed into a short molecular structure to accelerate the combustion speed of the fuel after the jetting into the cylinder. Further, said fuel is passed through a constricted gap at a high speed to be charged with static electricity. By being ejected into the cylinder, static electricity is discharged to make the ignition speed faster, thus supressing the generation of fuel cinders. The inside of the cylinder is by nature under high temperature/high pressure condition so that the jetting of the charged fuel thereinto remarkably improves its ignition performance to speed up the ignition. In addition, the high speed passing of the fuel through the gap in tube ring 60 causes the same to vibrate at a high frequency to accelerate a further activation of the fuel molecules.

While the space in fuel pocket 52 is shown as a location to accommodate said spiral tube ring 60 in the above explanation, a member separate from nozzle body 51 in the form of piece 58 having fuel pocket 59 therein may be used. Selection of the location may be determined in accordance with various factors such as the assemblage easiness, the engine capacity, etc.

Further, said spiral tube ring 60 so far explained may be replaced with a dought-nut shaped coil formed by continuously winding a wire into a single coil so that it is accommodated in either One of fuel pockets 52 and 59 or in both thereof. In this embodiment, the jetting power and the ignition performance are not inferior to the previous embodiment.

While the processes leading to the results may not be clear enough in the foregoing embodiments, it is assumed that a part of the light oil is transformed into a short molecular structure with the result that when the nozzle is opened, the light oil components in the fuel is at first jetted into the cylinder in the form of methane/butane gas to be burned therein, and in the above mentioned combustion the remaining components are further supplied to accomplish a practically perfect combustion. This enhances turbulence in the latter half phase in one combustion discussed by a number of researchers, said turbulence reducing the generation of nitrogen oxides and smoke together with the cutdown of fuel consumption.

The 10 mode value of a vehicle loaded With the system of the present invention recorded 0.53 g., meeting the target NOX emission standard of 0.6 g per 1 km travelling distance in the light-weight vehicle section (body weight less than 1.7 tons) provided for in the 1993 version of the emission standard regulation by the Environmental Agency (test results measurement conducted by Japan Automobile Transportation Engineering Society).

Figure 7:
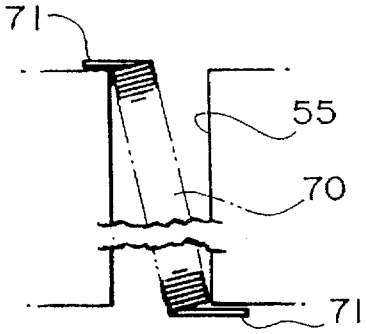
FIG. 7 is a cross sectional view of a state in which the metal coil means in a still further embodiment is attached.
Figure 8:
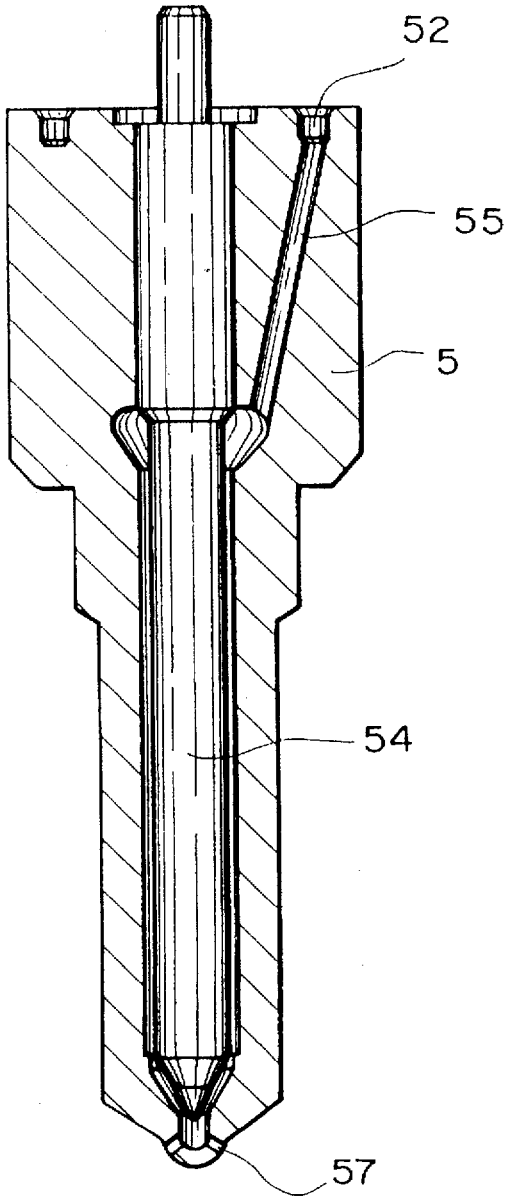
FIG. 8 is a cross sectional view of a still further embodiment of the invention which is incorporated in the jet nozzle.

While the embodiments in which tube rings 60 are accommodated in fuel pocket 52 and/or fuel pocket 59 are shown in the forgoing explanations, a coil member or spiral tube 70 of a metal material similar to a thin tube may be accommodated in the supply passage 55 of nozzle body 51. In such type, tube 70 inserted into supply passage 55 is secured at opposite ends 71 thereof to the ends of the supply passage 55 (FIG. 7).

Alternatively, said tube 70 may be accommodated in supply passage 59*a* formed in piece 58.

Said tube 70 may be of circular cross section, irregular elliptical cross section containing straight portions or triangular cross section containing rounded angle portions 70' (FIGS. 5 and 6) for shaping convenience or emission control.

Further, favorable results are obtained if such tubes are accommodated in supply passages 55 and 59*a* at an angle with respect to the axis thereof as opposed to be installed axially parallel. This is presumably because fuel receives twisting or turbulence action when the fuel passes the gap in spiral tube 70, so that the jetting power within the cylinder is increased.

As clearly explained in the foregoing, a perfect mixture of the fuel and air is obtained while the fuel is evenly dispersed within the cylinder under high pressure to achieve a practically perfect combustion. Therefore, an output of conventional level is obtained with a small amount of fuel so that the fuel consumption is maintained low to assure that the generation of nitrogen oxides is suppressed in a mimimum amount. In the diesel engine, it is possible to suppress the generation of black smoke, vibration, noise, etc.

While the explanations has been made in connection with the diesel engine, it is needless to say that the present invention is applicable not only to a gasoline engine but also to the burner of a combustion furnace or the burner of a boiler. Further, a spiral tube formed by winding a mesh material may be adopted in place of a spiral tube formed by a metal wire. Further, a similar result is expected by a material perforated through an etching process.

According to the present invention, it is possible to atomize the fuel into particles during the supply process of the liquid fuel into the combustion engine. It is also possible to supply a fuel having a strong jetting power under high pressure such that perfect combustion as well as an even combustion is made possible to suppress the generation of nitrogen oxides, sulfuric oxides and soots. Further, static electricity is discharged from the fuel charged therewith such that the fuel is ignited immediately after being jetted. Thus, the present invention is useful in that all these achieved performances contribute to prevent the pollution of the environment while the engine outputs are improved without the generation of vibration, black smoke, noise, etc.

What is claimed is:

1. An exhaust gas purification system for combustion of a fluid fuel at a combustion section, comprising:

a nozzle adapted to receive the fluid fuel and to provide the fuel to the combustion section for burning the fuel, said nozzle including a nozzle body having a valve opening directly communicating the combustion section for burning the fuel, and fuel supply passages communicating with the valve opening, and a needle disposed in the nozzle body and opening the valve opening, and at least one metal coil means situated in at least one of the fuel supply passages, said metal coil means having means to activate the fuel when the fuel passes through the at least one of the fuel supply passages and contacts the metal coil means situated therein so that the fuel is atomized into particles to have static electricity and is immediately supplied to the combustion section.

2. An exhaust gas purification system according to claim 1, wherein said fuel supply passages include a first fuel pocket inside the valve opening, a plurality of first passages directly communicating with the first fuel pocket, and a second fuel pocket disposed at a side opposite to the first fuel pocket and directly communicating with the first passages, said at least one metal coil means being situated in at least one of the first passages and the second fuel pocket.

3. An exhaust gas purification system according to claim 2, wherein each of said first passages includes one metal coil means therein.

4. An exhaust gas purification system according to claim 2, wherein said second fuel pocket has an annular shape, and said at least one metal coil means has coil portions with hollow portions therein, said coil portions being arranged annularly and situated in the second fuel pocket in the annular shape.

5. An exhaust gas purification system according to claim 2, wherein said nozzle further includes a piece disposed above the nozzle body to define the second fuel pocket between the nozzle body and the piece and having a plurality of second passages communicating with the second fuel pocket, each of said second passages having said metal coil means.

6. An exhaust gas purification system according to claim 1, wherein said at least one metal coil means is formed of at least one metal selected from the group consisting of copper oxide, iron, nickel, cobalt and gold, and the fuel is pressurized at 100 to 300 $kg/cm^2$.

7. An exhaust gas purification system according to claim 1, wherein said metal coil means includes a composite coil member composed of a first coil member and a second coil member inserted into said first coil, said first coil member being formed into a ring with said second ring therewithin.

8. An exhaust gas purification system according to claim 1, wherein said metal coil means includes a single coil member.

9. An exhaust gas purification system according to claim 1, wherein said metal coil means is of circular cross section.

10. An exhaust gas purification system according to claim 1, wherein said metal coil means is of elliptical cross section.

11. An exhaust gas purification system according to claim 1, wherein said metal coil means is of triangular cross section.

* * * * *